US006021838A

United States Patent [19]

Taffe

[11] Patent Number: 6,021,838

[45] Date of Patent: Feb. 8, 2000

[54] LOUVERED SECURITY WINDOW

[76] Inventor: Lansley O. Taffe, 7 Maplewood Ave., Bloomfield, Conn. 06002

[21] Appl. No.: 09/095,968

[22] Filed: Jun. 11, 1998

[51] Int. Cl.[7] ..... E06B 9/30

[52] U.S. Cl. ..... 160/172; 160/176.1 R; 49/74.1

[58] Field of Search ..... 49/82.1, 86.1, 49/81.1, 74.1; 160/172 R, 176.1 R

[56] References Cited

U.S. PATENT DOCUMENTS

| | | | |
|---|---|---|---|
| 1,179,328 | 4/1916 | Lancaster | 160/172 R |
| 2,059,134 | 10/1936 | Metcalf | 160/172 R |
| 2,299,095 | 10/1942 | Knox | 160/172 R |
| 2,369,493 | 2/1945 | Rood | 160/172 R |
| 3,744,544 | 7/1973 | Wellensiek | 160/172 R |
| 3,853,169 | 12/1974 | Music et al. | 160/172 R |

FOREIGN PATENT DOCUMENTS

| | | | |
|---|---|---|---|
| 1114036 | 11/1954 | France | 160/172 R |

*Primary Examiner*—Blair M. Johnson

[57] ABSTRACT

A new louvered security window for providing security features while providing an emergency exit. The inventive device includes a window frame and elongate first and second guide members that are disposed in the window frame. Each of the guide members has a top end, a bottom end, and a rod receiving slot that extends therethrough between the top and bottom ends of each guide member. A plurality of spaced apart elongate rods are disposed in the rod receiving slots of the guide members. A plurality of louver-type panels extend between the guide members and each of the panels is mounted on a respective rod. The rods are rotatable about their longitudinal axes between an open position and a closed position. Side edges of each of the panels are spaced apart from the side edges of the adjacent panels when the rods are in an open position. The side edges of the panels generally overlap portions of the adjacent panels when the rods are in a closed position. The panels may be lifted merely by sliding the lowest rod upwards up by using a lifting mechanism that is coupled to the lowest rod. The rods may also be selectively locked in place to prevent burglary.

11 Claims, 3 Drawing Sheets

LOUVERED SECURITY WINDOW

BACKGROUND OF THE INVENTION

1. Field of the Invention

The present invention relates to louver assemblies and more particularly pertains to a new louvered security window for providing security features while providing an emergency exit.

2. Description of the Prior Art

The use of louver assemblies is known in the prior art. More specifically, louver assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art louver assemblies include U.S. Pat. No. 4,688,351; U.S. Pat. No. 4,481,734; U.S. Pat. No. 4,018,024; U.S. Pat. No. 4,018,259; U.S. Pat. No. 4,991,349; and U.S. Pat. No. Des. 273,518.

While these devices fulfill their respective, particular objectives and requirements, the aforementioned patents do not disclose a new louvered security window. The inventive device includes a window frame and elongate first and second guide members that are disposed in the window frame. Each of the guide members has a top end, a bottom end, and a rod receiving slot that extends therethrough between the top and bottom ends of each guide member. A plurality of spaced apart elongate rods are disposed in the rod receiving slots of the guide members. A plurality of louver-type panels extend between the guide members and each of the panels is mounted on a respective rod. The rods are rotatable about their longitudinal axes between an open position and a closed position. Side edges of each of the panels are spaced apart from the side edges of the adjacent panels when the rods are in an open position. The side edges of the panels generally overlap portions of the adjacent panels when the rods are in a closed position. The panels may be lifted merely by sliding the lowest rod upwards up by using a lifting mechanism that is coupled to the lowest rod. The rods may also be selectively locked in place to prevent burglary.

In these respects, the louvered security window according to the present invention substantially departs from the conventional concepts and designs of the prior art, and in so doing provides an apparatus primarily developed for the purpose of providing security features while providing an emergency exit.

SUMMARY OF THE INVENTION

In view of the foregoing disadvantages inherent in the known types of louver assemblies now present in the prior art, the present invention provides a new louvered security window construction wherein the same can be utilized for providing security features while providing an emergency exit.

The general purpose of the present invention, which will be described subsequently in greater detail, is to provide a new louvered security window apparatus and method which has many of the advantages of the louver assemblies mentioned heretofore and many novel features that result in a new louvered security window which is not anticipated, rendered obvious, suggested, or even implied by any of the prior art louver assemblies, either alone or in any combination thereof.

To attain this, the present invention generally comprises a window frame and elongate first and second guide members that are disposed in the window frame. Each of the guide members has a top end, a bottom end, and a rod receiving slot that extends therethrough between the top and bottom ends of each guide member. A plurality of spaced apart elongate rods are disposed in the rod receiving slots of the guide members. A plurality of louver-type panels extend between the guide members and each of the panels is mounted on a respective rod. The rods are rotatable about their longitudinal axes between an open position and a closed position. Side edges of each of the panels are spaced apart from the side edges of the adjacent panels when the rods are in an open position. The side edges of the panels generally overlap portions of the adjacent panels when the rods are in a closed position. The panels may be lifted merely by sliding the lowest rod upwards up by using a lifting mechanism that is coupled to the lowest rod. The rods may also be selectively locked in place to prevent burglary.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new louvered security window apparatus and method which has many of the advantages of the louver assemblies mentioned heretofore and many novel features that result in a new louvered security window which is not anticipated, rendered obvious, suggested, or even implied by any of the prior art louver assemblies, either alone or in any combination thereof.

It is another object of the present invention to provide a new louvered security window which may be easily and efficiently manufactured and marketed.

It is a further object of the present invention to provide a new louvered security window which is of a durable and reliable construction.

An even further object of the present invention is to provide a new louvered security window which is susceptible of a low cost of manufacture with regard to both materials and labor, and which accordingly is then susceptible of low prices of sale to the consuming public, thereby making such louvered security window economically available to the buying public.

Still yet another object of the present invention is to provide a new louvered security window which provides in the apparatuses and methods of the prior art some of the advantages thereof, while simultaneously overcoming some of the disadvantages normally associated therewith.

Still another object of the present invention is to provide a new louvered security window for providing security features while providing an emergency exit.

Yet another object of the present invention is to provide a new louvered security window which includes a window frame and elongate first and second guide members that are disposed in the window frame. Each of the guide members has a top end, a bottom end, and a rod receiving slot that extends therethrough between the top and bottom ends of each guide member. A plurality of spaced apart elongate rods are disposed in the rod receiving slots of the guide members. A plurality of louver-type panels extend between the guide members and each of the panels is mounted on a respective rod. The rods are rotatable about their longitudinal axes between an open position and a closed position. Side edges of each of the panels are spaced apart from the side edges of the adjacent panels when the rods are in an open position. The side edges of the panels generally overlap portions of the adjacent panels when the rods are in a closed position. The panels may be lifted merely by sliding the lowest rod upwards up by using a lifting mechanism that is coupled to the lowest rod. The rods may also be selectively locked in place to prevent burglary.

Still yet another object of the present invention is to provide a new louvered security window that promotes security by permitting the rods holding the panels to be selectively locked in place, thereby preventing theft.

Even still another object of the present invention is to provide a new louvered security window that promotes safety by permitting the panels to be lifted open to provide an exit merely by lifting the rods and associated panels up when the rods are unlocked.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
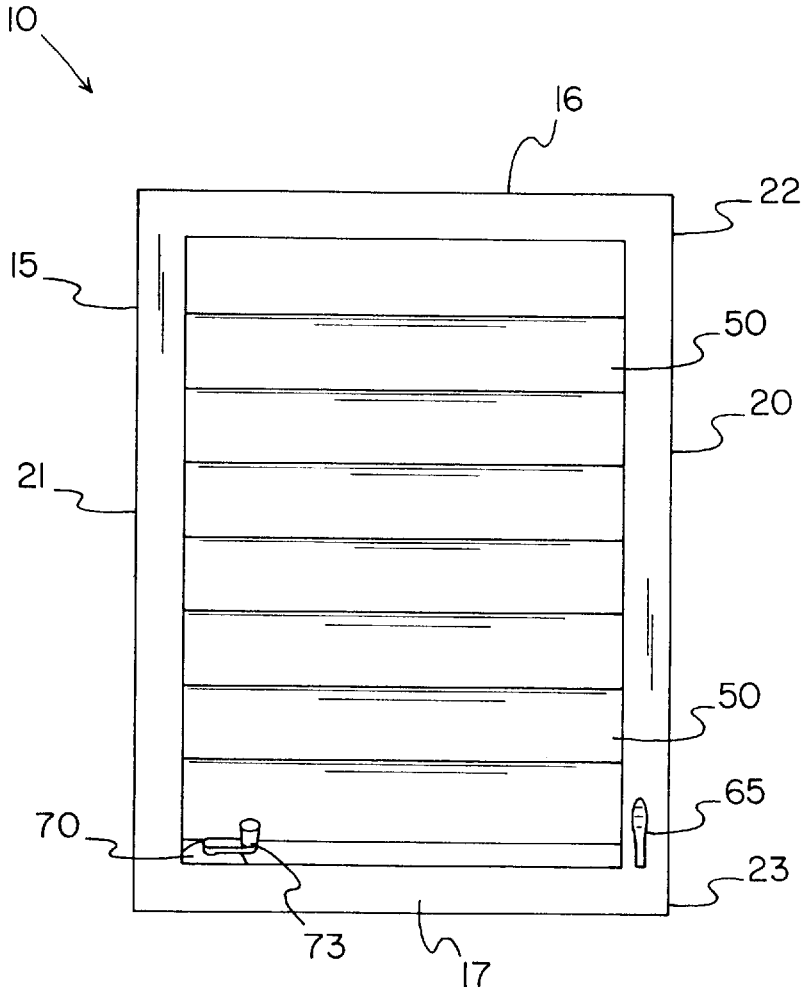
FIG. 1 is a schematic side view of a new louvered security window according to the present invention.

With reference now to the drawings, and in particular to FIGS. 1 through 5 thereof, a new louvered security window embodying the principles and concepts of the present invention and generally designated by the reference numeral 10 will be described.

As best illustrated in FIGS. 1 through 5, the louvered security window 10 comprises a window frame 15 and elongate first and second guide members 30,31 that are disposed in the window frame 15. Each of the guide members 30,31 has a top end 32, a bottom end 33, and a rod receiving slot 34 that extends therethrough between the top and bottom ends 32,33 of each guide member 30,31. A plurality of elongate rods 40 are disposed in the rod receiving slots 34 of the guide members 30,31. The longitudinal axes of the rods 40 are spaced apart and generally parallel. Each rod 40 has a louver-type panel 50 mounted on it. Each panel 50 extends between the guide members 30,31 and has a pair of ends 51 and a pair of side edges 52 that extends between the ends 51. Each of the ends 51 of the panels 50 is positioned adjacent a respective guide member 30,31. The rods 40 are rotatable about their longitudinal axes between an open position and a closed position. The side edges 52 of each of the panels 50 are spaced apart from the side edges 52 of the adjacent panels 50 when the rods 40 are in an open position. The side edges 52 of the panels 50 generally overlap portions of the adjacent panels 50 when the rods 40 are in a closed position.

Preferably, each of the rods 40 has a first end 41, a second end 42, and a longitudinal axis extending between the ends 41,42. Each of the first ends 41 of the rods 40 are slidably disposed in the rod receiving slot 34 of the first guide member 30. Each of the second ends 42 of the rods 40 are slidably disposed in the rod receiving slot 34 of the second guide member 31. The highest of the rods 40 is positioned towards the upper cross member 16 of the window frame 15. The lowest of the rods 40 is positioned towards said lower cross member 17 of the window frame 15.

Also preferably, each of the rods 40 is slidable in the rod receiving slots 34 between the top ends 32 and the bottom ends 33 of the guide members 30,31. In such an embodiment, a lifting mechanism 70 may be used to lift the rods 40 towards the upper cross member 16 of the window frame 15. Most preferably, as particularly illustrated in FIG. 3, the lifting mechanism 70 comprises a plurality of pulleys 71, a lift cord 72 that extends around the pulleys 71, and a handle 73 for rotating one of the pulleys 71. Ideally, four pulleys 71 are used.

The lift cord 72 is coupled to the lowest of the rods 40. The lift cord 72 pulls the lowest of the rods 40 towards the upper cross member 16 of the window frame 15 when one of the pulleys 71 is rotated in a first direction. As the lowest of the rods 40 moves towards the top ends 32 of the guide members 30,31, it pushing all of the rods 40 towards the upper cross member 16 of the window frame 15. When the pulley 71 is rotated in a second direction, the lift cord 72 pulls the lowest of the rods 40 towards the lower cross member 17 of the window frame 15.

Preferably, a locking mechanism (not shown) is provided that selectively locks the lowest of the rods 40 in a position towards the bottom ends 33 of the guide members 30,31.

Also preferably, the louvered security window 10 also includes a plurality of pairs of suspension belts 60. A pair of suspension belts 60 extend around a pair of adjacent rods 40 for suspending the lower rod 40 of the pair of rods from the immediately higher rod 40 of the pair of rods. Ideally, each suspension belt 60 of the pair of suspension belts 60 is positioned towards a respective end 41,42 of a rods.

The window frame 15 has first and second elongate frame members 20,21 that are spaced apart and generally rectangular and upper and lower cross members 16,17 that extend between the first and second frame members 20,21. Preferably, each of the frame members 20,21 has an upper end 22, a lower end 23, and a main slot 24 that extends therethrough between the upper and lower ends 22,23. Each of the main slots 24 have an upper slot end (not shown), a lower slot end 29 and a length that is defined between the slot ends of the main slot 24.

The first guide member 30 is disposed in the main slot 24 of the first frame member 20. The second guide member 31 is disposed in the main slot 24 of the second frame member 21. The bottom ends 33 of each of the guide members 30,31 rest on the lower slot end 29 of the associated main slot 24 of the associated frame member 20,21.

In such an embodiment, each of the rods 40 has a pair of cams 46. Each of the cams 46 is positioned on the rods 40 such that each of the cams is disposed in a main slot 24 of a respective frame member 20,21. The first guide member 30 is slidable in a first direction and a second direction. The line of movement of the first guide member 30 back and forth in the first and second directions is substantially perpendicular to the longitudinal axis of the main slot 24 of the first frame member 20. The cams 46 press against one side of the main slot 24 of the first frame member 20 and rotate the rods 40 about their longitudinal axis towards an open position when the first guide member 30 is slid in the first direction. The cams 46 press against the other side of the main slot 24 of the first frame member 20 and rotate the rods 40 about their longitudinal axis towards a closed position when the first guide member 30 is slid in the second direction.

Figure 2:
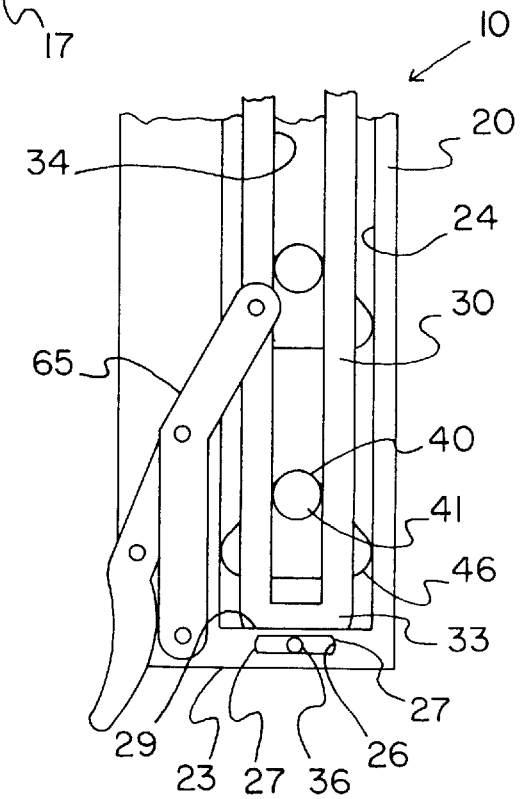
FIG. 2 is a detailed side view of the present invention.
Figure 3:
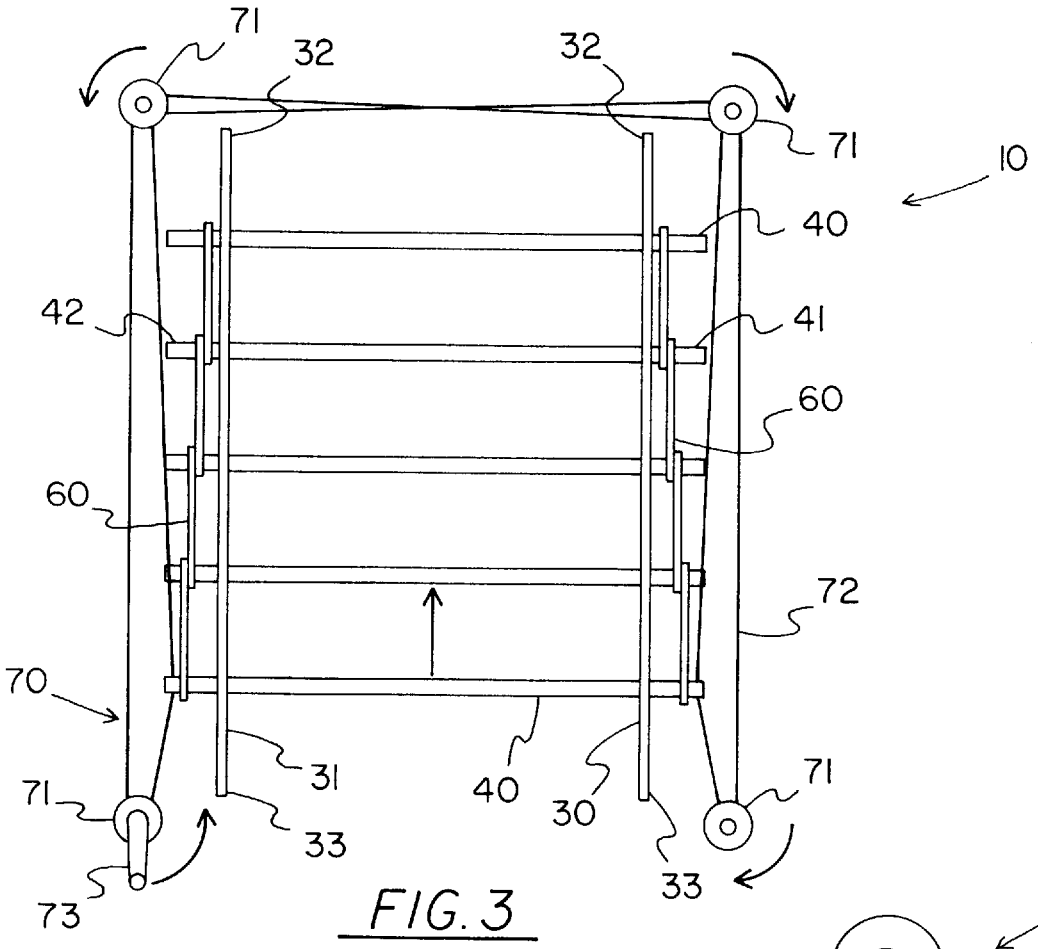
FIG. 3 is a schematic side view of the present invention particularly illustrating a lifting mechanism for lifting the rods towards the top ends of the guide members.
Figure 4:
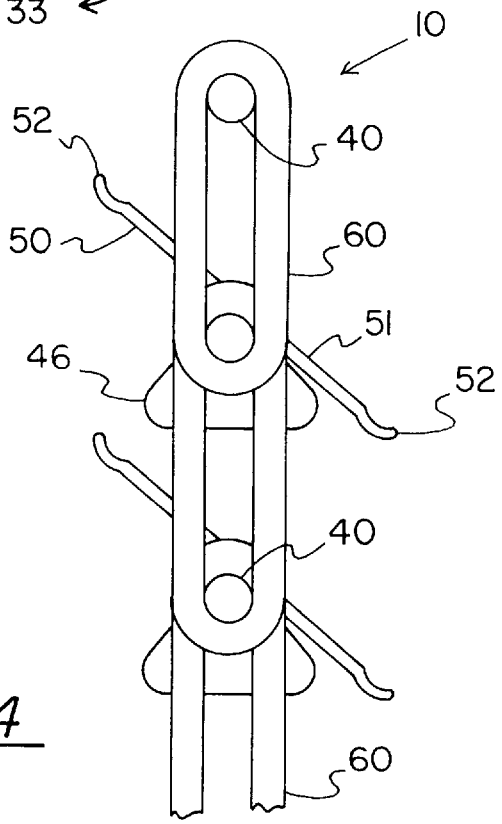
FIG. 4 is a detailed side view of the present invention.
Figure 5:
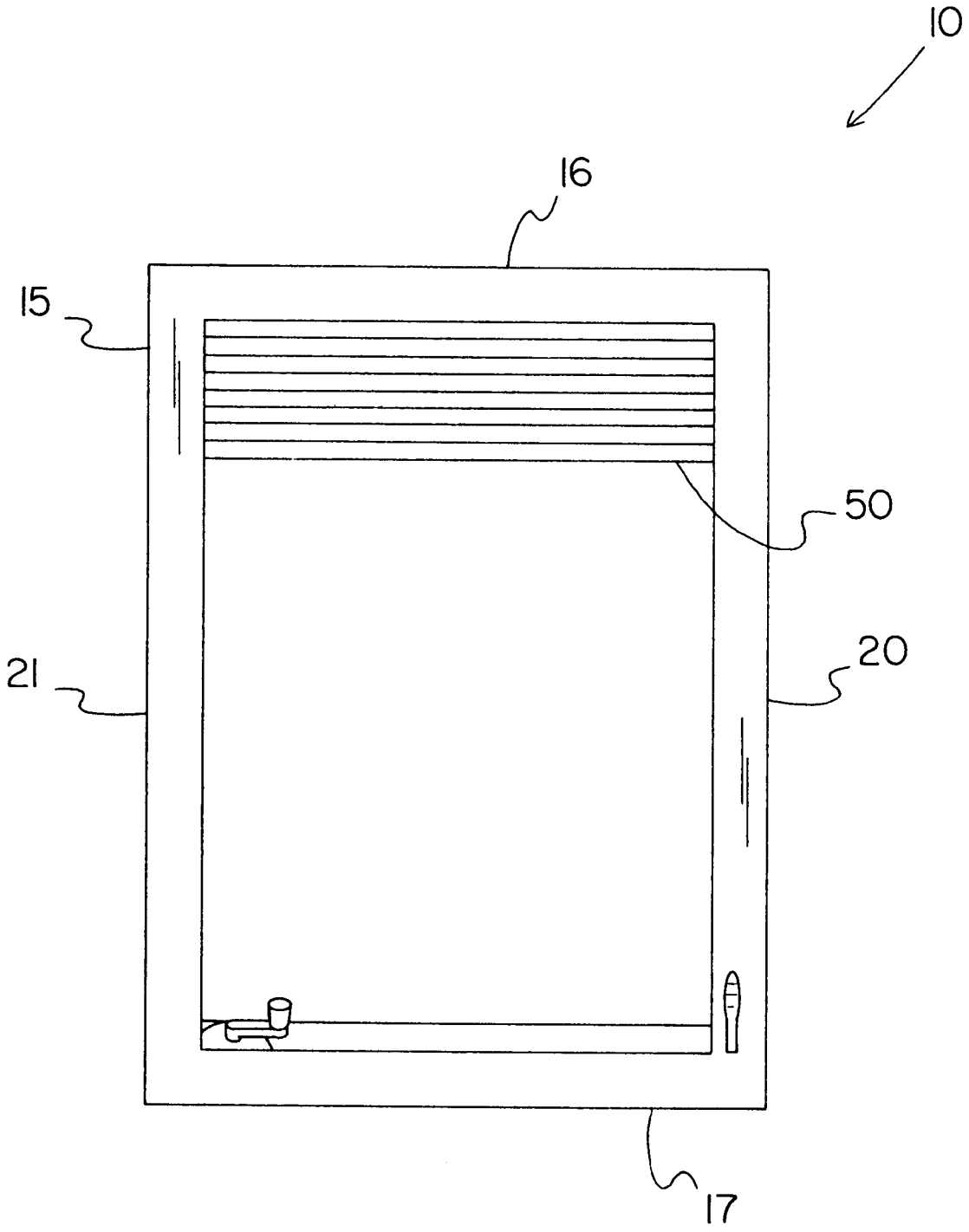
FIG. 5 is a schematic side view of the present invention with the rods and panels lifted towards the top ends of the guide members.

More preferably, as illustrated in FIG. 2, a sliding mechanism 65 slides the first guide member 30 in the first and second directions. Ideally, the sliding mechanism 65 also selectively locks the rods 40 in the closed position when the rods 40 are in the closed position.

Preferably, the first frame member 20 has an elongate upper slot (not shown) that is positioned between the main slot 24 and the upper end 22 of the first frame member 20. The upper slot (not shown) has a pair of ends (not shown) and a length that is defined between the ends of the upper slot.

The first frame member 20 also has an elongate lower slot 26 that is positioned between the main slot 24 and the lower end 23 of the first frame member 20. The lower slot 26 has a pair of ends 27 and a length that is defined between the ends 27 of the lower slot 26. The upper slot (not shown) is substantially similar to the lower slot 26 of the first frame member 20. Also, the lengths of the upper and lower slots of the first frame member 20 are substantially perpendicular to the length of the main slot 24 of the first frame member 20.

The first guide member 30 has a first peg (not shown) that extends from the top end 32 of the first guide member 30. The first peg is slidably inserted in the upper slot (not shown) of the first frame member 20 such that the first peg is slidable along the length of the upper slot. The first guide member 30 also has a second peg 36 that extends from the bottom end 33 of the first guide member 30. The second peg 36 is slidably inserted in the lower slot 26 of the first frame member 20 such that the second peg 36 is slidable along the length of the lower slot 26. The first and second pegs limit the extent of movement of the first guide member 30 in the first and second directions. Ideally, the lengths of the upper and lower slot of the first frame member 20 are substantially perpendicular to the length of the main slot 24 of the first frame member 20.

In use, the sliding mechanism 65 is manipulated to slide the first guide member 30 in a first or a second direction to rotate the rods 40 between an open and a closed position, thereby opening and closing the panels 50. The sliding mechanism 65 may also selectively lock the rods 40 in the closed position. The panels 50 are lifted towards the upper cross member 16 of the window frame 15 by the lifting mechanism 70. The panels 50 may also be lifted by grasping the lowest panel 50 and sliding it towards the upper cross member 16 of the window frame 15. To ensure that the panels 50 are not opened, a locking mechanism (not shown) may be used to lock the lower rods 50 in a position towards the lower cross member 17 of the window frame 15.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A louvered security window, comprising a window frame having first and second frame members being spaced apart and upper and lower cross members extending between said first and second frame members;

first and second guide members being disposed in said window frame, each of said guide members having a top end, a bottom end, and a rod receiving slot extending therethrough between said top and bottom ends of each said guide member;

a plurality of elongate rods being disposed in said rod receiving slots of said guide members, the longitudinal axes of said rods being spaced apart and generally parallel;

each of said frame members of said window frame having an upper end, a lower end, and an elongate main slot extending therethrough between said upper and lower ends of said frame members, said first guide member being disposed in said main slot of said first frame member, said second guide member being disposed in said main slot of said second frame member, said first frame member having an elongate upper slot being positioned between said main slot and said upper end of said first frame member, said first frame member having an elongate lower slot being positioned between said main slot and said lower end of said first frame member, the lengths of said upper and lower slots being substantially perpendicular to the length of the main slot of the first frame member, wherein said first guide member having a first peg being extended from said top end of said first guide member, said first peg being slidably inserted in said upper slot of said first frame member such that said first peg is slidable along the length of said upper slot, said first guide members having a second peg being extended from said bottom end of said first guide member, said second peg being slidably inserted in said lower slot of said first frame member such that said second peg is slidable along the length of said lower slot;

each of said rods having a panel mounted thereon, each of said panels being extended between said guide members, each of said panels having a pair of ends and a pair of side edges extending between said ends, each of said ends of said panels being positioned adjacent a respective guide member; and wherein said rods are rotatable about their longitudinal axes between an open position and a closed position, said side edges of each of said panels being spaced apart from said side edges of the adjacent panels when said rods are in said open position, said side edges of said panels generally overlapping portions of adjacent panels when said rods are in said closed position.

2. The louvered security window of claim 1, wherein said rods are slidable in said rod receiving slots of said guide members between said top ends and said bottom ends of said guide members, wherein a lowest of said rods is positioned towards said lower cross member of said window frame.

3. The louvered security window of claim 1, further comprising a plurality of pairs of suspension belts, each of said pair of suspension belts being extended around a pair of adjacent rods for suspending the lower rod of said pair of rods from the higher rod of said pair of rods.

4. The louvered security window of claim 2, further comprising a lifting mechanism for lifting said rods towards said upper cross member of said window frame.

5. The louvered security window of claim 4, wherein said lifting mechanism comprises a plurality of pulleys and a lift cord being extended around said pulleys, said lift cord being coupled to the lowest of said rods, said lift cord pulling the lowest of said rods towards said upper cross member of said window frame when one of said pulleys is rotated in a first direction, said lift cord pulling said lowest of said rods towards said lower cross member of said window frame when said pulley is rotated in a second direction.

6. The louvered security window of claim 1, wherein each of said rods has a pair of cams, each of said cams being positioned on said rods such that each of said cams is disposed in a said main slot of a respective frame member.

7. The louvered security window of claim 6, wherein said first guide member is slidable in a first direction and a second direction, said cams rotating said rods about their longitudinal axes towards said open position when said first guide member is slid in said first direction, said cams rotating said rods about their longitudinal axes towards said closed position when said first guide member is slid in said second direction.

8. The louvered security window of claim 7, further comprising a sliding mechanism for sliding the first guide member in the first and second directions, wherein said sliding mechanism selectively locks said rods in said closed position when said rods are in said closed position.

9. The louvered security window of claim 1, wherein the lengths of said upper and lower slots of said first frame member are substantially perpendicular to the length of said main slot of said first frame member.

10. The louvered security window of claim 2, further comprising a locking mechanism for selectively locking the lowest of the rods in a position towards the lower cross member of said window frame.

11. A louvered security window, comprising:

a window frame having elongate first and second frame members being spaced apart and generally rectangular and upper and lower cross members being spaced apart and extending between said first and second frame members, each of said frame members having an upper end, a lower end, and an elongate main slot extending therethrough between said upper and lower ends of said frame members;

wherein each of said main slots have an upper slot end, a lower slot end, and a length being defined between said slot ends of said main slot;

said first frame member having an elongate upper slot being positioned between said main slot and said upper end of said first frame member, wherein said upper slot has a pair of ends and a length being defined between said ends of said upper slot;

said first frame member having an elongate lower slot being positioned between said main slot and said lower end of said first frame member, wherein said lower slot has a pair of ends and a length being defined between said ends of said lower slot;

wherein the lengths of said upper and lower slots of said first frame member are substantially perpendicular to the length of said main slot of said first frame member;

elongate first and second guide members, said first guide member being disposed in said main slot of said first frame member, said second guide member being disposed in said main slot of said second frame member, each of said guide members having a top end, a bottom end, and a rod receiving slot extending therethrough between said top and bottom ends of said guide member, said bottom end of each of said guide members being rested on a said lower slot end of a main slot of the associated frame member;

said first guide member having a first peg extending from said top end of said first guide member, said first peg being slidably inserted in said upper slot of said first frame member such that said first peg is slidable along the length of said upper slot;

said first guide member having a second peg being extended from said bottom end of said first guide member, said second peg being slidably inserted in said lower slot of said first frame member such that said second peg is slidable along the length of said lower slot;

a plurality of elongate rods, each of said rods having first and second ends and a longitudinal axis extending between said ends of said rods, each of said first ends of said rods being slidably disposed in said rod receiving slot of said first guide member, each of said second ends of said rods being slidably disposed in said rod receiving slot of said second guide member, the longitudinal axes of said rods being spaced apart and generally parallel, said rods being slidable in said rod receiving slots between said top ends and said bottom ends of said guide members, a highest of said rods being positioned towards said upper cross member of said frame, a lowest of said rods being positioned towards said lower cross member of said frame;

each of said rods having a panel being mounted thereon, each of said panels being extended between said guide members, each of said panels having a pair of ends and a pair of side edges extending between said ends, each of said ends of said panels being positioned adjacent a respective guide member;

wherein said rods are rotatable about their longitudinal axes between an open position and a closed position, said side edges of each of said panels being spaced apart from said side edges of the adjacent panels when said rods are in said open position, said side edges of said panels generally overlapping portions of adjacent panels when said rods are in said closed position;

a plurality of pairs of suspension belts, a pair of suspension belts being extended around each pair of adjacent rods for suspending the lower rod of said pair of rods from the higher rod of said pair of rods, each belt of said pair of belts being positioned towards a respective end of a said rod;

each of said rods having a pair of cams, each of said cams being positioned on said rods such that each of said cams is disposed in a said main slot of a respective frame member;

said first guide member being slidable in a first direction and a second direction, said cams rotating said rods about their longitudinal axes towards said open position when said first guide member is slid in said first direction, said cams rotating said rods about their longitudinal axes towards said closed position when said first guide member is slid in said second direction;

a sliding mechanism for sliding said first guide member in the first and second directions;

wherein said sliding mechanism selectively locks said rods in said closed position when said rods are in said closed position;

a lifting mechanism for lifting said rods towards said upper cross member of said frame, said lifting mechanism comprising a plurality of pulleys and a lift cord being extended around said pulleys and coupled to the lowest of said rods;

said lift cord pulling the lowest of said rods towards said upper cross member of said frame when one of said pulleys is rotated in a first direction, said lowest of said rods thereby pushing all of said rods towards said upper cross member of said frame;

said lift cord pulling said lowest of said rods towards said lower cross member of said frame when said pulley is rotated in a second direction; and a locking mechanism for selectively locking the lowest of said rods in a position towards said lower cross member of said frame.

* * * * *